US010513862B2

(12) United States Patent
Bunn

(10) Patent No.: US 10,513,862 B2
(45) Date of Patent: Dec. 24, 2019

(54) SYSTEM, METHOD, AND APPARATUS FOR SIMULATING IMMERSION IN A CONFECTION

(71) Applicant: Maryellis Bunn, New York, NY (US)

(72) Inventor: Maryellis Bunn, New York, NY (US)

(73) Assignee: Maryellis Bunn, New York, NY (US)

( * ) Notice: Subject to any disclaimer, the term of this patent is extended or adjusted under 35 U.S.C. 154(b) by 0 days.

(21) Appl. No.: 15/816,379

(22) Filed: Nov. 17, 2017

(65) Prior Publication Data

US 2019/0153737 A1 May 23, 2019

(51) Int. Cl.
*E04H 4/00* (2006.01)
*A63G 31/00* (2006.01)

(52) U.S. Cl.
CPC ..... *E04H 4/00* (2013.01); *A63G 31/00* (2013.01)

(58) Field of Classification Search
CPC .. A63G 21/00; A63B 5/00; A63B 5/10; A63H 6/025; A63H 17/00; A63H 33/00; A63H 33/32; A63H 2009/006; E04H 4/00
USPC ..... 472/116, 117, 126, 128; 446/70
See application file for complete search history.

(56) References Cited

U.S. PATENT DOCUMENTS 3,256,532 A 6/1966 Lindsey
3,409,916 A 11/1968 Billig
3,942,198 A * 3/1976 Jewett ..... A63B 5/10 4/494
4,168,061 A 9/1979 Gordon
4,245,838 A 1/1981 Gordon
4,343,464 A * 8/1982 Dose ..... A63G 21/00 190/1
5,592,702 A 1/1997 Gillebaard, Jr.
D382,618 S 8/1997 Gift
6,342,014 B1 1/2002 Lynch
6,511,382 B1 * 1/2003 Ochi ..... A63B 67/002 472/134
6,739,876 B2 * 5/2004 Ochi ..... A63B 67/002 434/258
2003/0163873 A1 9/2003 Price
2009/0211168 A1 8/2009 Bogar

FOREIGN PATENT DOCUMENTS

DE 3341083 5/1985

OTHER PUBLICATIONS

European Patent Application No. 18207122.5, Search Report dated Mar. 29, 2019.

* cited by examiner

*Primary Examiner* — Kien T Nguyen
(74) *Attorney, Agent, or Firm* — Sheppard, Mullin, Richter & Hampton LLP

(57) ABSTRACT

A system, method, and apparatus for simulating immersion in a confection may comprise a container, a plurality of fanciful elements removably positioned within the container, and one or more structural elements attached to the container. In some embodiments, the present invention may further comprise a platform that may be configured to support one or more surfaces of the container. In some embodiments, the fanciful elements may be synthetic multicolored sprinkles.

14 Claims, 7 Drawing Sheets

SYSTEM, METHOD, AND APPARATUS FOR SIMULATING IMMERSION IN A CONFECTION

GOVERNMENT CONTRACT

Not applicable.

CROSS-REFERENCE TO RELATED APPLICATIONS

Not applicable.

STATEMENT RE. FEDERALLY SPONSORED RESEARCH/DEVELOPMENT

Not applicable.

COPYRIGHT & TRADEMARK NOTICES

A portion of the disclosure of this patent document may contain material which is subject to copyright protection. This patent document may show and/or describe matter which is or may become trade dress of the owner. The copyright and trade dress owner has no objection to the facsimile reproduction by any one of the patent document or the patent disclosure, as it appears in the Patent and Trademark Office patent files or records, but otherwise reserves all copyrights and trade dress rights whatsoever.

TECHNICAL FIELD

The disclosed subject matter relates generally to experience simulation and, more particularly, to a system, method, and apparatus for simulating immersion in a confection.

BACKGROUND

Whether for entertainment, renewal, mindfulness, or physical rehabilitation, the reasons for the human proclivity towards immersive activities are endless. A variety of mediums are known to support such activities. Naturally, a variety of containers configured to hold these diverse immersive mediums exist. One common example is a pool configured to hold water. A pool configured to hold fresh water treated with chemicals may provide a cool clean feeling, whereas a saltwater pool may provide more buoyancy. Other containers may be configured to contain other substances intended to offer alternative immersive experiences, such as for example mud for mud baths, gels for resistance training, or even edible gelatin deserts for novelty. However, few if any containers are configured to contain a plurality of fanciful elements. Such a container containing such a medium would offer not only the tactile benefits of partial or total immersion, its fanciful nature could potentially also evoke a transformative emotional, psychological, even spiritual experience of which an aqueous medium may not be capable.

Although various containers configured to encompass various mediums are known in the art, none are sufficiently configured to contain a plurality of fanciful elements. One commonly known container, the pool configured for use with aqueous substances, is unfortunately designed only to contain water. For example, U.S. Pat. No. 5,592,702, incorporated by reference in its entirety herein, discloses a modular above-ground pool system. Its free-standing and adjustable elements may presumably be adjusted and connected to form a circular above ground pool of variable diameter and height. Or, the disclosure of U.S. Pat. No. 3,409,916, incorporated by reference in its entirety herein, provides for a more permanent oval-shaped pool. Further, the disclosure of U.S. Pat. No. 3,256,532, incorporated by reference in its entirety herein, discloses a portable square-shaped pool that may presumably be easily assembled and disassembled. While containers having a pool-like shape are convenient and familiar to users, none of these are configured for use with non-aqueous immersion mediums.

Alternative containers exist as well. For example, U.S. Patent Application Publication No. 2009/0211168, incorporated by reference in its entirety herein, discloses a children's play apparatus that could be filled, for example, with the impact-absorbing foam blocks of U.S. Patent Application Publication No. 2003/0163873, which is also incorporated by reference in its entirety herein. Such a combination would provide a user with a type of immersive experience in the foam blocks. Or, as is disclosed in U.S. Pat. No. D382,618, incorporated by reference in its entirety herein, other containers can be configured to contain balls, and provide another type of "ball pit" immersive experience. Some containers may even contain impact-absorbing substances into which a person may sink, such as the disclosures of U.S. Pat. Nos. 4,245,838 and 4,168,061, both of which disclose impact-absorbing crash pads for use with track and field events, both of which are incorporated by reference in their entireties herein. However therapeutic the feeling of sinking into such pads may be, these disclosures do not enable an immersive experience.

What is needed therefore is a system that provides a container configured for use with non-aqueous fanciful elements that enables partial or total immersion, and a method of using the same.

SUMMARY

The present disclosure is directed to a system, method, and apparatus for immersion in a non-aqueous medium, in addition to other properties. More specifically, the present invention is directed to a system, method, and apparatus for simulating immersion in a confection.

It is contemplated that the "confection," as used herein, in which a user may partially or entirely immerse one's self, may be a plurality of discrete real or synthetic elements, or variations on real or synthetic elements (collectively herein, "fanciful elements"). By way of illustration and not limitation, one type of fanciful element contemplated for use with the present invention is a discrete plastic element shaped as an ice cream sprinkle. As will be discussed more fully herein, the present invention contemplates many different types of fanciful elements in addition to sprinkles. The collection of one or more types of fanciful elements, such as sprinkles of various colors, sizes, and shapes, collectively, may be referred to as a confection.

The term "granular" as used herein describes a plurality of discrete individual elements that are generally, but need not be, larger than a grain of sand or salt. The plurality of granular elements, such as a plurality of discrete plastic fanciful elements shaped as sprinkles, may fill a container either partially or fully. Because such elements are small, in some embodiments they may be capable of being easily moved to accommodate the insertion of a body part or person. The term "granular" is used to distinguish the plurality of fanciful elements provided by the present invention from an aqueous substance that could fill a container. For example, it is contemplated that the container of the present invention is configured to contain "granular" elements, such as a plurality of fanciful elements, and is not configured to contain water. Thus, the field of endeavor contemplated by the present invention is containers adapted for use with non-aqueous mediums. Any reference to containers adapted for use with aqueous mediums is intended herein for use as contrast.

The terms "real" and "natural" as used herein describes items or elements in the states or conditions in which they are normally found, regardless of ingredients or growing conditions. For example, a "real" or "natural" peach would be any peach grown on a tree, and a "real" or "natural" sprinkle would be any edible sprinkle. A "synthetic" or "semi-synthetic" element as used herein refers to an element in a condition not normally the one in which it is normally found. By way of illustration and not limitation, a plastic sprinkle, a plastic unit of popped popcorn, and a plastic chocolate chip would all be synthetic fanciful elements.

Unless otherwise specified herein, the fanciful elements discussed herein are generally presumed to be relatively small synthetic or semi-synthetic elements, but in some embodiments, may also be natural. By way of illustration and not limitation, a fanciful element as used herein may be a real, synthetic, or semi-synthetic sprinkle, popsicle, gummy bear, ice cream cone, scoop of ice cream, cone, chocolate chip, brownie, cookie, a candy or candy bar, a dessert topping, or another sweet treat or combination of sweet treats.

Additionally, in some embodiments, a fanciful element may also encompass other real, synthetic, or semi-synthetic miniature versions of various elements. By way of illustration and not limitation, a fanciful element could be a miniature reproduction of a savory treat, such as popcorn, small slices of pizza, small slices of bacon, or cereal. Or, a fanciful element could be a miniature version of other types of objects or things, such as by way of illustration and not limitation, a star, a human likeness, a creature, a doll, an accessory such as a cowboy hat or purse, an emoji, a thumbs-up, a shape such as a sphere or cube, a plurality of shapes of varying sizes, and so forth.

In some embodiments, the present invention generally comprises a system for simulating immersion in a confection, the system generally comprising a container, a plurality of fanciful elements removably positioned within the container, and one or more structural elements attached to the container. In some embodiments, the present invention may further comprise a platform.

In some embodiments, the fanciful elements may be miniature plastic capsules. Furthermore, in some embodiments, the miniature plastic capsules may be shaped as multicolor sprinkles. Moreover, in some embodiments, the miniature plastic capsules may be of any length and diameter known in the art. It is contemplated that in some embodiments, the present invention may provide for a plurality of discrete plastic sprinkles that may be of any color or colors, size or sizes, and shape or shapes, as described herein.

In some embodiments, the sprinkles may range from one millimeter to one meter in length, or longer or shorter. In some embodiments, the sprinkles may range from one centimeter to five centimeters. In some embodiments, the sprinkles may be one centimeter. In some embodiments, the diameter of the sprinkles may range from one millimeter to fifty centimeters. In some embodiments, the diameter of the sprinkles may range from one millimeter to one centimeter. In some embodiments, the diameter of the sprinkles may be two millimeters. In some embodiments, the sprinkles may be shaped similarly to capsules, having a cylindrical body and two rounded ends. In some embodiments, the sprinkles may have a cylindrical body, one flat end, and one rounded end. In some embodiments, the sprinkles may have a cylindrical body and two flat ends. In some embodiments, such as when the sprinkles are small, the sprinkles may be solid or substantially solid. In embodiments wherein the sprinkles are larger, the sprinkles may be hollow and full of one or more gasses.

In some embodiments, a plastic may comprise some or all of the plurality of fanciful elements. As used herein, "plastic" may comprise any polymer such as but not limited to any polyethylene terephthalate (PET or PETE), polyethylene (PE), low density polyethylene (LDPE), or high density polyethylene (HDPE), polyvinyl chloride (PVC), polypropylene (PP), polystyrene (PS), polyurethane (PU), high impact polystyrene (HIPS), acrylonitrile butadiene styrene (ABS), or any synthetic or semi-synthetic plastic, thermoplastic, thermosetting polymer, or bioplastic.

Additionally, in some embodiments, "coloring agent" may comprise any pigment or dye sufficient to impart a color to a plastic. By way of illustration and not limitation, a "pigment" may be a plurality of insoluble, finely-divided organic or inorganic, or combination of organic and inorganic, solid particles that may be physically retained within a plastic. Additionally, a "dye" may be a soluble organic or inorganic, or combination of organic and inorganic, liquid that may lose its crystal or particulate structure and that may be held in place via its affinity with the plastic. Furthermore, "coloring agent," in some embodiments, may also include one or more additives to aid coloring agent dispersion, such as by way of illustration and not limitation, metal soaps, such as zinc and calcium stearate, thylene bisstearamide (EBS) wax, oxidized PE wax, internal mold release agents, plasticizers, flame retardants, and slip agents. Such elements may be used in combination with a dye or pigment, or both, in the coloring agent.

In some embodiments, the antimicrobial agent may comprise an organic antimicrobial formulation or substance (an "organic antimicrobial"), an inorganic microbial formulation or substance (an "inorganic microbial"), or a combination of organic microbial and an inorganic antimicrobial. By way of illustration and not limitation, organic antimicrobials may include phenolic biocides, quaternary ammonium compounds, fungicides, and any other organic antimicrobial known in the art. In some embodiments, inorganic antimicrobials may be silver-based, zinc-based, copper-based or based on any element, ion, compound or molecule known in the art to be more likely than not to provide an antimicrobial effect.

In some embodiments, the plastic composition of some or all of the fanciful elements may comprise 90-97% plastic, 2-9% coloring agent, and 1-8% antimicrobial agent by weight. In some embodiments, the plastic composition of some or all of the fanciful elements may comprise 95-97.5% plastic, 2-4.5% coloring agent, and 0.5-1% antimicrobial agent by weight (at times, "wt. %" herein).

In some embodiments, the container may be configured in a shape reminiscent of a swimming pool, hot tub, wading pool, kiddie pool, or any other type of pool known in existence (collectively, "swimming pool" or simply "pool") wherein the container defines at least one center cavity (or "compartment"), such as may be found in a swimming pool. In some embodiments, the container may provide for at least one upper portions having at least one upper surface (or "top side"), one or more wall portions (or "walls") that may comprise the perimeter of the compartment, and one or more floors or bottom portions ("floor(s)" or "bottom(s)") that may comprise the lower surface(s) of the compartment. In contrast to one or more of the pools mentioned above that are known in the art, the portions of the present invention that provide for, comprise, or define the compartment may be configured to removably retain the plurality of fanciful elements.

In some embodiments, the at least one structural element may be in a shape reminiscent of a diving board connected to one or more portions of the container's top side. In some embodiments, the diving board may be comprised of a stiff material that can bear the weight of one or more human beings without bending appreciably. In such embodiments, the diving board may be supported by one or more additional elements, such as a metal pole or a post of any kind. In some embodiments, however, the diving board may be composed of a material or materials that may bend appreciably under any range of weight from a modicum of weight to the weight of several human beings. As well, in some embodiments, the diving board may be affixed to one or more walls, one or more floors, or any combination of upper surface, walls, and/or floors. In some embodiments, the diving board may extend partially across the container's opening. In some embodiments, two or more diving boards may extend partially across the container's opening.

In some embodiments, the at least one structural element may be at least one ladder configured for use with a swimming pool. Such a ladder may be a commercially-available ladder adapted for use with the container. In some embodiments, the at least one ladder may be an element configured to resemble a ladder. In some embodiments, the at least one ladder may be fixedly connected to at least one portion of the top side. In some embodiments, the at least one ladder may be fixedly connected to one or more walls. In some embodiments, the at least one ladder may be fixedly connected to a combination of at least one portion of the top side, one or more walls, and one or more floors. In some embodiments, the at least one ladder may be removably connected to at least one portion of the top side, at least one wall, at least one floor, or a combination of one or more of at least one top side surface, at least one wall, and at least one floor.

Additionally, the present invention may provide that the at least one structural elements may be in the shape of a fountain. In some embodiments, the fountain may be configured to appear as though it can cycle the fanciful elements like a traditional fountain cycles water. In some embodiments, the fountain may be configured to cycle the fanciful elements like a traditional fountain cycles water.

In some embodiments, the container may be configured to resemble an above-ground swimming pool. In such embodiments of the container, it is provided that the at least one structural element may be at least one right-angle support, or other type of support, typically found on the outside of an above-ground pool. In some embodiments, the container or other elements of the present invention may rest upon or within one or more platforms.

In some embodiments, the container may be shaped similar to an in-ground swimming pool or hot tub. In some such embodiments, one of the at least one structural elements may be one or more platforms. In some embodiments, the present invention's container may be embedded within one or more platforms having one or more steps or stairs.

In embodiments providing for at least one platform, it is contemplated that in some embodiments the platform may surround the container, as with a container shaped similarly to an in-ground swimming pool. In such embodiments, the platform may comprise one or more layers. In some embodiments, the first layer may resemble a house's frame, such that it may comprise, by way of example and not limitation, wooden beams joined together by nails, screws, mounting plates, hinges, plywood, particle board, insulation, concrete, bricks, and so forth. In some embodiments, the second layer may comprise fiberglass, acrylic, PVC, steel, cast iron, other types of metal, other plastics, elastomer, and any other element suitable for a similar purpose. In some embodiments, the first and/or second layers may be hidden from view.

In some embodiments, the third layer of the platform may comprise an impact-absorbing element. In some embodiments, the impact-absorbing element may comprise one or more floor portions, or may be located on one or more floor portions, or both. Such impact-absorbing element(s) may comprise a foam layer, an elastomer layer, a plastic layer, a layer of movable impact-absorbing elements such as by way of illustration and not limitation foam blocks, or any other element capable of cushioning. The impact-absorbing element may comprise a single element, such as a layer of a substance or combination of substances mentioned herein, or it may comprise a plurality of individual elements mentioned herein, such as a plurality of foam blocks, woodchips, or a rubber mulch. In some embodiments, the impact-absorbing element may be a combination of a layer of one or more substances and one or more additional substances located either above or below the layer.

In some embodiments, the platform may further comprise one or more poles or other vertical elements configured to support one or more other elements. By way of illustration and not limitation, one such vertical element could be one or more poles (or raised elements) configured to support at least one diving board, at least one catwalk, at least one ladder, at least one fountain, at least one bench, or any other structural element or combination of structural elements.

In some embodiments, the at least one structural element may be at least one aesthetic element. The possibilities for such an aesthetic element are bounded only by the art, but could include, but are not limited to, different types of walls, such as at least one wall configured to resemble a shower wall, a locker room wall, a public swimming pool complex wall, or a different type of wall-like element. Additionally, the at least one structural element may be at least one element commonly found at water parks, spas, Turkish baths, steam rooms, spa tubs, saunas, and so forth, such as by way of illustration and not limitation, one or more lockers, one or more diving boards, one or more benches, one or more towel racks and/or towels, one or more lighting elements, one or more signs, one or more doors, one or more mats, and so forth. In some embodiments, the at least one structural element could be an element found more broadly, such as a sculpture, a fountain, a catwalk, a mannequin or other human-like object, an audio-visual presentation, and so forth. Other elements described above, such as the at least one diving board, at least one fountain, at least one catwalk, or at least one structural support may also be configured for use as primarily or supplementary an aesthetic element as well.

In some embodiments, the present invention may further comprise at least one novelty item. By way of illustration and not limitation, such a novelty item could comprise a beach ball of any size, shape, or color.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

One or more of the above-disclosed embodiments, in addition to certain alternatives, are provided in further detail below with reference to the attached figures. The disclosed subject matter is not, however, limited to any particular embodiment disclosed.

Figure 1:
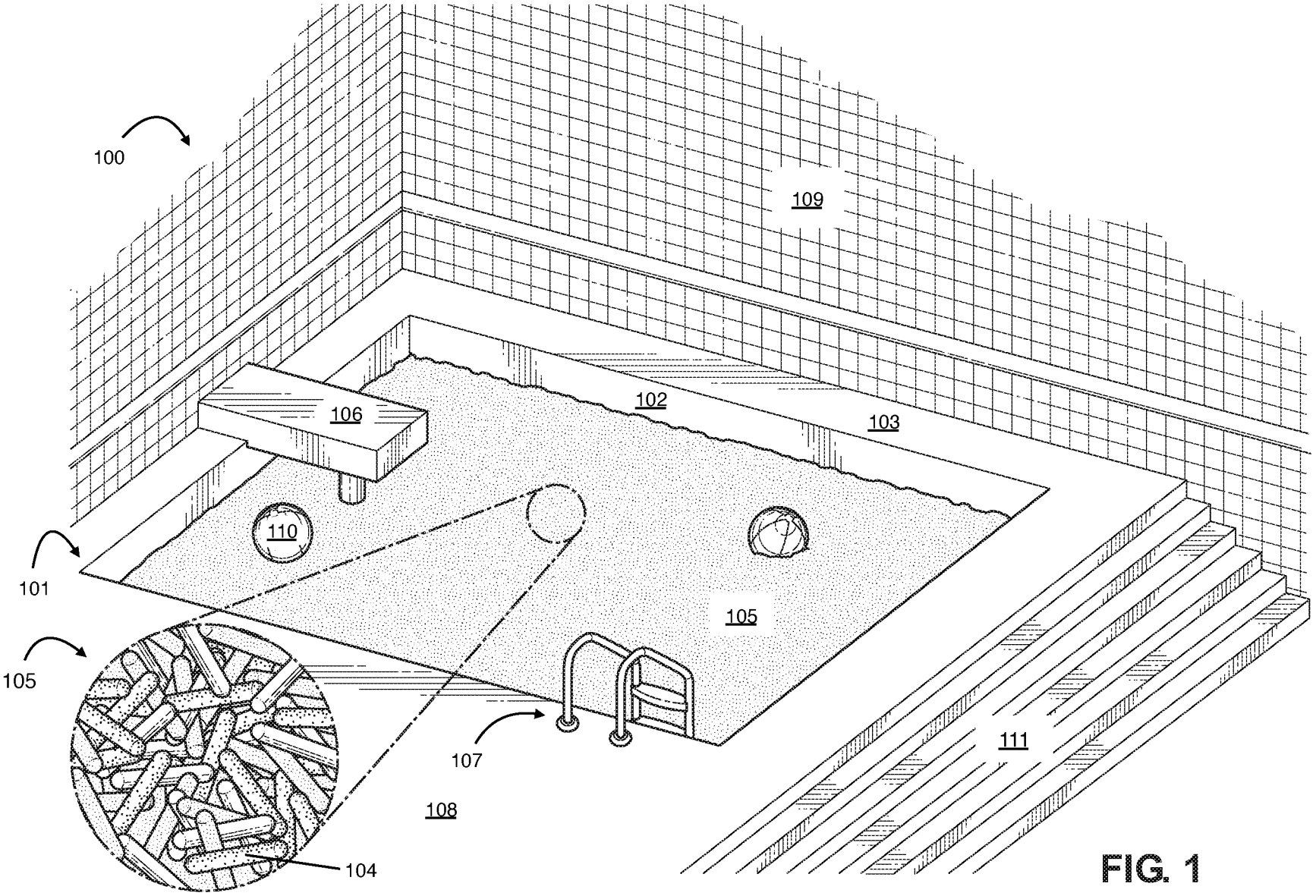
FIG. 1 shows a top-perspective view of a system for simulating immersion in a confection in accordance with an embodiment of the invention.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "couple," "coupled," "couples," "coupling," and the like should be broadly understood and refer to connecting two or more elements or signals, electrically, mechanically or otherwise. Two or more electrical elements may be electrically coupled, but not mechanically or otherwise coupled; two or more mechanical elements may be mechanically coupled, but not electrically or otherwise coupled; two or more electrical elements may be mechanically coupled, but not electrically or otherwise coupled. Coupling (whether mechanical, electrical, or otherwise) may be for any length of time, e.g., permanent or semi-permanent or only for an instant.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

With reference to FIG. 1, a viewer may perceive a top-perspective view of a system for simulating immersion in a confection in accordance with an embodiment of the invention. In the embodiment depicted, system for simulating immersion in a confection 100 may comprise a container 101, container walls 102, container upper surface 103, fanciful element 104, plurality of fanciful elements 105, diving board 106, ladder 107, platform surface 108, platform walls 109, novelty item 110, and stairs 111 may be perceived.

In addition to the shape of container 101 depicted in FIG. 1, container 101 may be of any shape capable of practice with the present invention. By way of illustration and not limitation, in some embodiments, when viewed from a top-plan or an "above" viewpoint, container 101 may resemble a circle, an oval, a triangle, a heart, a rectangle, a number, a symbol, or any other shape. Furthermore, and also by way of illustration and not limitation, in some embodiments, when viewed from a side or an "elevational" viewpoint, such as either a front-side, a rear-side, a right-side, or a left-side view, or a view at any angle of any side such as a corner view, container 101 may resemble a "U", a "V" In some embodiments, one or more angles between the container walls 102 and the floor (not pictured in FIG. 1) of container 101 may be right, acute, or obtuse to any degree. Additionally, the floor (not pictured in FIG. 1) of container 101 may also provide for one or more raised portions. Thus, the overall contour(s) of container 101, when viewed from the top or any side, may also take any shape. As well, container 101 may be of larger or smaller size than depicted in FIG. 1, and may be shallower or deeper than shown in FIG. 1 or as depicted in other Figures disclosed herein. It is contemplated that container 101 may be comprised of any material known in the art, such as by way of illustration and not limitation, concrete, wood, metal, plastic, carbon fiber, glass, tempered glass, elastomer, any combination of such materials, or any other material known in the art suitable for use as a platform. Additionally, in some embodiments, container 101 may be divided into one or more segments or areas via one or more dividers or elements on the floor of container 101. Such segmented areas of container 101 may take any size or shape, such as by way of illustration and not limitation, segments dividing container 101 in half, in thirds, in fourths, or in unequal portions.

Similarly, container walls 102 may be of any shape. In some embodiments, one or more container walls 102 may be straight. In some embodiments, one or more container walls 102 may provide for one or more deviations from an otherwise straight plane. In some embodiments, one or more container walls 102 may provide for one or more cavities, one or more protrusions, or one or more recessed portions. By way of illustration and not limitation, one or more cavities within container walls 102 may provide for an area into which a user might reach or set an object, one or more protrusions might be configured for use as a chair or seat, and one or more recessed portions might be configured to receive one or more objects, such as the back of a head, for example. As well, container walls 102 may provide for one or more levels or planes, such as by way of illustration and not limitation, a series of protrusions comprising one or more steps. It is contemplated that container walls 102 may be comprised of any material known in the art, such as by way of illustration and not limitation, concrete, wood, metal, plastic, carbon fiber, glass, tempered glass, elastomer, any combination of such materials, or any other material known in the art suitable for use as a platform.

Remaining with FIG. 1, container upper surface 103, in some embodiments, may provide for a perimeter surface surrounding container 101. In some embodiments, container upper surface 103 may entirely surround container 101. In some embodiments, container upper surface 103 may partially surround container 101 at one or more sides of container 101. It is contemplated, in one or more embodiments, that container upper surface 103 may provide the point of attachment for one or more structural elements of the present invention. By way of illustration and not limitation, in FIG. 1, a viewer may perceive that diving board 106 and ladder 107 are shown as connected to container upper surface 103. In some embodiments, container upper surface 103 may also provide for the upper stair or point of connection for stairs 111. In some embodiments, container upper surface 103 may provide for an uneven surface or one or more other surface elements. By way of illustration and not limitation, container upper surface 103 may provide for one or more cavities, one or more depressed or lower portions, or one or more raised portions. In some embodiments, for example, one or more cavities in container upper surface 103 may be configured as a cup holder or mobile phone holder, one or more depressed portions of container upper surface 103 may be configured as a seat into which a user may sink, and one or more raised portions of container upper surface 103 may be configured as one or more benches or chair-like protrusions. Such examples are provided solely for illustration, and any manner of surface feature is contemplated for container upper surface 103. By way of illustration, other such surface features of container upper surface 103 may include, for example, one or more glass or transparent elements configured to cover an exhibit, one or more lights, or an aquarium; one or more digital monitors capable of use with a computer, television, or projector; one or more movable elements such as a trap door or a portion that raises, lowers, or slides either mechanically or as programmed by one or more automation elements; one or more elements configured to raise out of or lower into the cavity created by a portion that raises, lowers, or slides, and so forth. In some embodiments, container upper surface 103 may be either partially or, in some embodiments entirely, comprised of any such element. It is contemplated that container upper surface 103 may be comprised of any material known in the art, such as by way of illustration and not limitation, concrete, wood, metal, plastic, carbon fiber, glass, tempered glass, elastomer, any combination of such materials, or any other material known in the art suitable for use as a platform.

Continuing with FIG. 1, in some embodiments, fanciful element 104 may be shaped as a sprinkle. As discussed above, when shaped as a sprinkle, fanciful element 104 may be generally capsule-shaped, and may be of any length and width, and may of any color. More specifically, in some embodiments, fanciful element 104 when shaped as a sprinkle, may range from one centimeter to five centimeters, and may range from one millimeter to two millimeters. Fanciful element 104, in some embodiments, and in any shape, may be comprised of plastic. Fanciful element 104, in some embodiments, and in any shape, may provide for one or more antimicrobial elements. It is contemplated that in some embodiments, as shown in FIG. 1, fanciful element 104 may be of a shape and size such that at least one fanciful element 104 may slide or otherwise be relatively easily movable against another fanciful element 104. In some embodiments, fanciful element 104 may be coated so as to minimize the friction and/or resistance associated with the contact of one fanciful element 104 against another fanciful element 104. Additionally, as described more fully elsewhere herein, fanciful element 104 may be shaped as a chocolate chip, a piece of popcorn (or "flake"), or any other shape capable of existing in a plurality within any container 101.

With continued respect to FIG. 1, in some embodiments, plurality of fanciful elements 105 may provide a movable substance in which a user may partially or entirely immerse one or more parts of the user's body. In some embodiments, a portion or all of the plurality of fanciful elements 105 may be configured to move so as to accommodate the insertion of one or more body parts of a user into plurality of fanciful elements 105. In some embodiments, a portion or all of the plurality of fanciful elements 105 may be configured to move so as to accommodate the insertion of the entirety of a user into plurality of fanciful elements 105. In some embodiments, plurality of fanciful elements 105 may behave in a manner similar to sand, gravel, or mud in its accommodation and surrounding of a user's body part or entire person. In some embodiments, one or more fanciful elements 104 may be coated or otherwise configured to enable plurality of fanciful elements 105 to behave in a liquid-like manner such that a user may meet with little to no resistance when the user inserts some or all of the user's body into plurality of fanciful elements 105. It is contemplated that by inserting some or all of a user's body into plurality of fanciful elements 105, the user may derive a psychological, physiological, emotional, spiritual, social, tactile, or other benefit.

Remaining with FIG. 1, in the embodiment depicted, a user may perceive diving board 106. As shown, diving board 106 extends partially over container 101. In some embodiments, diving board 106 may extend further, or entirely, over container 101. In some embodiments, the top surface of diving board 106 may be positioned above the plane of container upper surface 103, as shown in FIG. 1. In some embodiments, the top surface of diving board 106 may be positioned co-planar, or on a lower plane, as compared to the plane of container upper surface 103. In some embodiments, diving board 106 may be wider or narrower than the diving board 106 shown in FIG. 1. Additionally, in the embodiment disclosed in FIG. 1, diving board 106 is represented in a plank-shape, but need not be so configured. In some embodiments, by way of illustration and not limitation and purely by way of example, diving board 106 may be shaped as a surfboard, a rainbow, an ocean wave, a thought bubble, a sprinkle, a mint leaf, a bar of chocolate, an ice cream sandwich, an equation, a human likeness, an ice cream cone, and so forth. Any shape at all, of any size and/or dimensions, capable of achieving any portion of any function, including any purely aesthetic function, of diving board 106 is contemplated as an equivalent of diving board 106. It is contemplated that diving board 106 may be configured in some embodiments to support over one pound of weight, such as but not limited to the weight of a human being. In other embodiments, diving board 106 may be configured to only support less than one pound of weight, or no weight at all. In some embodiments, the present invention may provide for more than one diving board 106. In some embodiments, the present invention may lack diving board 106. It is contemplated that diving board 106 may be comprised of any material known in the art, such as by way of illustration and not limitation, concrete, wood, metal, plastic, carbon fiber, glass, tempered glass, elastomer, any combination of such materials, or any other material known in the art suitable for use as a platform.

Similarly, ladder 107 as shown in FIG. 1 may take any shape. By way of illustration and not limitation, ladder 107 may be shaped as a traditional swimming pool ladder as shown in FIG. 1, a rope ladder, a ramp, a slide, and so forth. It is contemplated that diving ladder 107 may be configured in some embodiments to support over one pound of weight, such as but not limited to the weight of a human being. In other embodiments, ladder 107 may be configured to only support less than one pound of weight, or no weight at all. In some embodiments, the present invention may provide for more than one ladder 107. In some embodiments, the present invention may lack ladder 107. It is contemplated that ladder 107 may be comprised of any material known in the art, such as by way of illustration and not limitation, concrete, wood, metal, plastic, carbon fiber, glass, tempered glass, elastomer, any combination of such materials, or any other material known in the art suitable for use as a platform.

Continuing with FIG. 1, the present invention may provide for platform surface 108. As can be seen in FIG. 1, platform surface 108 may occupy the portion just beyond and/or adjacent to container upper surface 103. In some embodiments, platform surface 108 may be contiguous with container upper surface 103. In some embodiments, the border between platform surface 108 and container upper surface 103 may be indistinguishable. It is contemplated that in some embodiments, platform surface 108 may provide for additional surface area near container 101 that may be used for, by way of illustration and not limitation, walking, sitting, standing, congregating, picture-taking, queuing, and any other such activities, together with any activity suitable or otherwise possible in conjunction with the present invention. Platform surface 108 may also be configured so as to provide for, in some embodiments, a surface upon which to set objects, such as chairs, bleachers, a slide, or any other element. It is contemplated that platform surface 108 may be comprised of any material known in the art, such as by way of illustration and not limitation, concrete, wood, metal, plastic, carbon fiber, glass, tempered glass, elastomer, any combination of such materials, or any other material known in the art suitable for use as a platform.

FIG. 1 also discloses platform walls 109, which in some embodiments, may bound container 101 on one or more sides. In the embodiment, shown in FIG. 1, platform walls 109 bound two sides of container 101, but in some embodiments, platform walls 109 may bound three sides of container 101. Embodiments wherein platform walls 109 may bound four or more sides of container 101, or entirely encompass container 101, are also contemplated. It is also contemplated that platform walls 109 may be of any size or shape conceivable. By way of illustration and not limitation, platform walls 109 may resemble bathroom tile, as generally depicted in FIG. 1, may resemble the concrete walls of a public swimming pool complex, wooden walls of a sauna, the plastic walls of a personal spa, and so forth. Platform walls 109 may also resemble one or more natural features, such as bamboo trees, sand dunes, slabs of marble, and so forth. Platform walls 109 may also resemble at least one playful or imaginative element, such as a waffle cone, a giant ice cream spoon, a gummy bear head, a wave of chocolate, a huge face or body part, a shoe, and so forth. It is contemplated that platform walls 109 may be comprised of any material known in the art, such as by way of illustration and not limitation, concrete, wood, metal, plastic, carbon fiber, glass, tempered glass, elastomer, any combination of such materials, or any other material known in the art suitable for use as a freestanding element or element in combination with any other element.

Remaining with FIG. 1, in some embodiments, novelty item 110 may comprise a beach ball as disclosed in FIG. 1. In some embodiments where novelty item 110 is a beach ball, it is contemplated that novelty item 110 may be of any size or shape beach ball known in the art. Additionally, in some embodiments, novelty item 110 may comprise a blow-up or authentic item of a different shape, such as an ice cream cone, a life preserver, an ice cream sandwich, a lifeguard's rescue tube or rescue can, a pool noodle, a pool float of any shape, a spoon, or any such item known in the confectionary, culinary, swimming pool, artistic, theatrical, visual, or performance arts, along with any other element conceivably used for novelty purposes.

Continuing with FIG. 1, a viewer may also perceive stairs 111 in the embodiment depicted. It is contemplated that in some embodiments, stairs 111 may be a traditional stepwise set of stars as depicted in FIG. 1. In some embodiments, stairs 111 may be configured as a spiral staircase, a ramp, a slide, a motorized platform, an elevator, a swing, or any other means for moving from one location or spot to another. It is contemplated that stairs 111 may be comprised of any material known in the art, such as by way of illustration and not limitation, concrete, wood, metal, plastic, carbon fiber, glass, tempered glass, elastomer, any combination of such materials, or any other material known in the art suitable for use as a freestanding element or element in combination with any other element.

Figure 2:
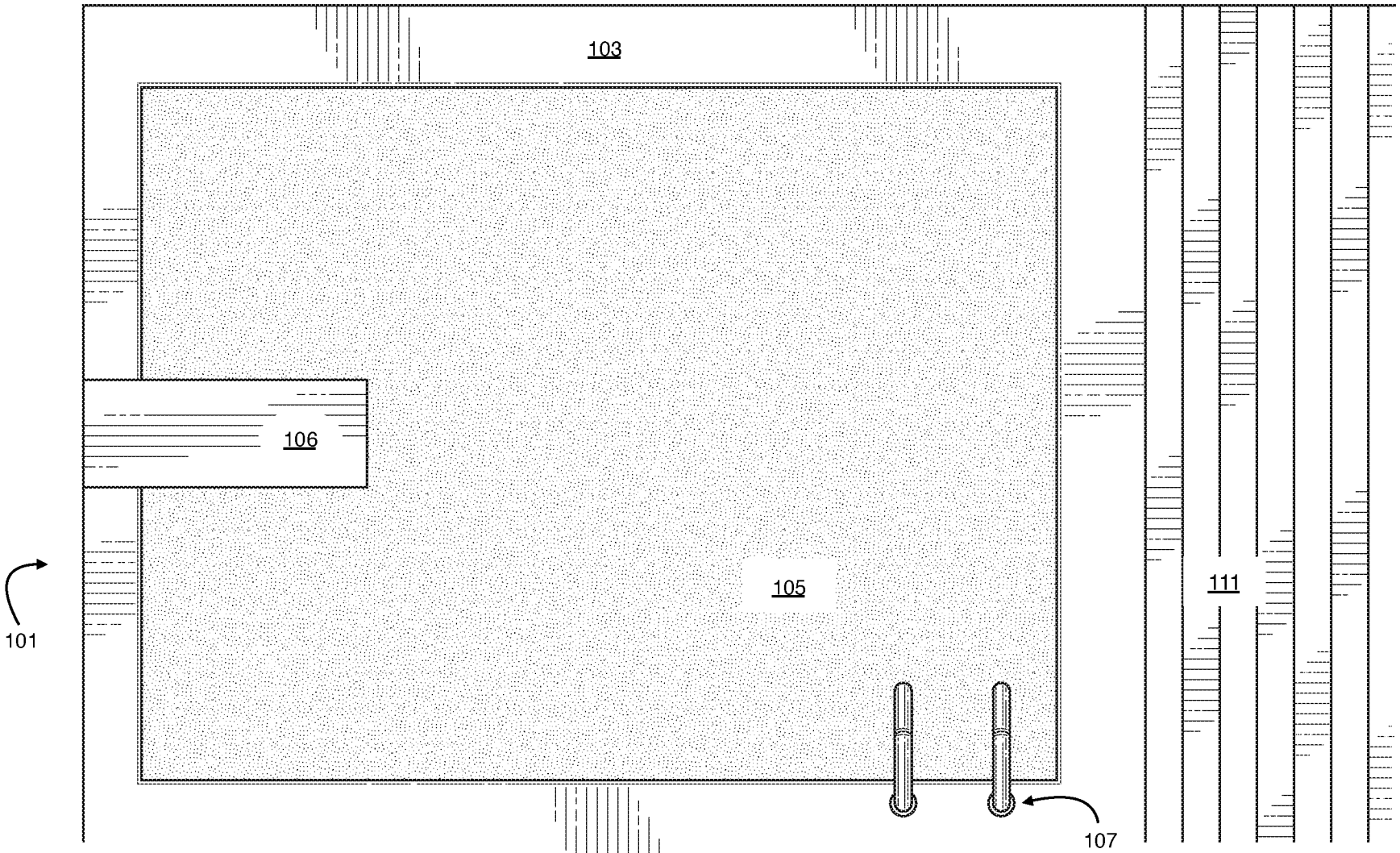
FIG. 2 shows a top planar view of an apparatus for simulating immersion in a confection in accordance with an embodiment of the invention.

Turning attention to FIG. 2, a top planar view of an apparatus for simulating immersion in a confection in accordance with an embodiment of the invention is shown. In the embodiment depicted, a viewer may perceive container 101, container upper surface 103, plurality of fanciful elements 105, diving board 106, and ladder 107.

In the embodiment depicted in FIG. 2, container 101 is depicted, from an overhead view, in the shape of a square. As mentioned above, in some embodiments, container 101 may take the shape from this view of a heart, an oval, a square, a rectangle, a scoop of ice cream, a cone, or any other shape.

Remaining with FIG. 2, and also as mentioned above, diving board 106 may be of any shape known in the art. By way of illustration and not limitation, diving board 106 may extend less or more across the face of container 101, and may fully extend across container 101 in some embodiments. Diving board 106 may also be of any thickness known in the art. In some embodiments, the present invention may provide for a plurality of diving boards 106. For example, the present invention may provide for a plurality of thin extensions protruding from a central hub, such as may hearken to mind the teeth of a comb. Furthermore, in some embodiments, one or more sides or ends of diving board 106 may not be straight as depicted in FIG. 2, but in some embodiments, one or more sides or ends of diving board 106 may be, by way of illustration and not limitation, curved, jagged, may provide for one or more notches, or have any other variation from a straight line capable of production or known in the art. Diving board 106 may be shaped in such a way as to resemble a known object, such as by way of example and not limitation, a surfboard, ice cream cone, ice cream sandwich, a smile, a wave, a sprinkle, or any other shape(s) or design, whether recognizable or abstract.

In FIG. 2, plurality of fanciful elements 105 may be perceived as substantially filling container 101. In some embodiments, plurality of fanciful elements 105 may fill container 101 less or more than depicted in FIG. 2. Additionally, in some embodiments, container 101 may be divided into one or more segments or areas via one or more dividers or elements on the floor of container 101. As such, in some embodiments, plurality of fanciful elements 105 may entirely or partially fill one or more segments and not entirely or partially fill one or more additional segments of container 101. Furthermore, in the embodiment depicted in FIG. 2, plurality of fanciful elements 105 are depicted a substantially uniform, that is, composed of one type of fanciful element 104 shaped as a "sprinkle." As mentioned above, it is contemplated, however, that in some embodiments, two or more shapes of fanciful element 104 may comprise plurality of fanciful elements 105. As such, in addition to the embodiment depicted in FIG. 2, in some embodiments, plurality of fanciful elements 105 may comprise a mix of two or more shapes of fanciful element 104.

Remaining with FIG. 2, ladder 107 may be of any size or shape. By way of illustration and not limitation, ladder 107 may have two handrail portions with steps in-between. Such an embodiment is shown with two steps visible in FIG. 1 and with all steps covered in FIG. 2. In some embodiments, ladder 107 may have one, three, or more handrails and any number of steps in-between. In some embodiments, ladder 107 may be a rope ladder, a spiral staircase, or any other shaped way into or out of container 101. For example, ladder 107 may be motorized or manually adjustable, may comprise a ramp, or could even comprise a slide.

Figure 3:
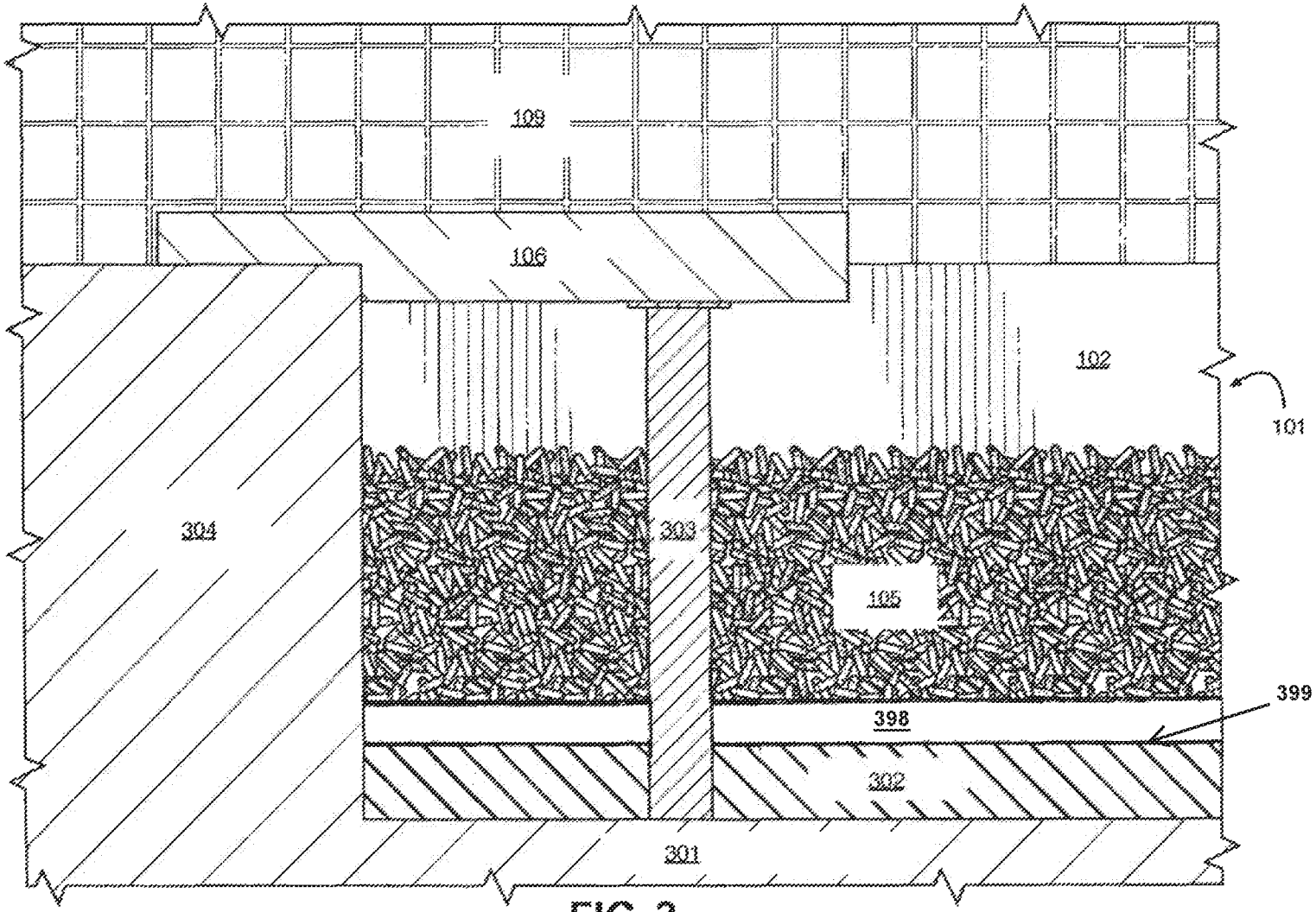
FIG. 3 shows a cutaway side view of a system for simulating immersion in a confection in accordance with an embodiment of the invention.

With respect to FIG. 3, in the embodiment depicted, a cutaway side view of a system for simulating immersion in a confection in accordance with an embodiment of the invention may be perceived. FIG. 3 shows bottom 301, impact-absorbing portion 302, pole 303, and platform support area 304, along with container 101, container walls 102, plurality of fanciful elements 105, and diving board 106.

Figure 7:
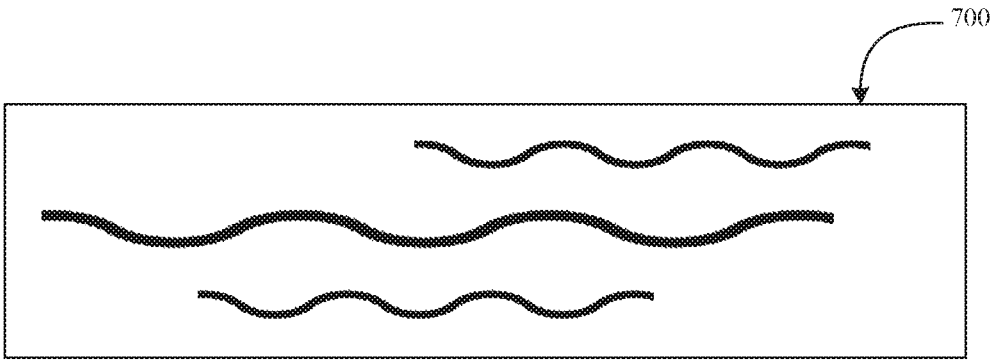
FIG. 7 shows a pouch filled with fluid in accordance with an embodiment of the invention.
Figure 8:
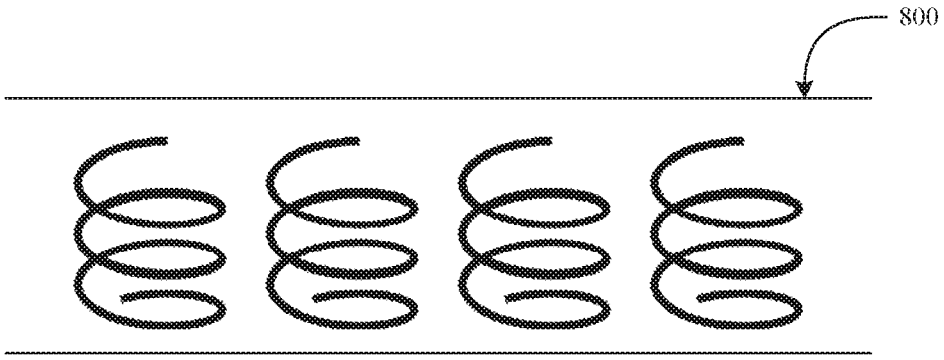
FIG. 8 shows a series of springs in accordance with an embodiment of the invention.

In some embodiments, bottom 301 may be substantially planar, or flat, as generally depicted in FIG. 3. In some embodiments, bottom 301 may be partially flat and may provide for one or more deviations, protrusions, or other departures from a planar configuration. Bottom 301 may, in some embodiments, be composed of plastic, wood, metal, concrete, elastomer, foam, packed earth, an aqueous element such as gel or water inside a pouch, 700 (see FIG. 7), a series of one or more springs 800 (see FIG.8), or any other element known to those of in the art.

Similarly, impact-absorbing portion 302 may include an impact-absorbing surface 399 that is entirely or substantially planar, or provide for one or more protrusions or deviations, such as lumps or crevices. Impact-absorbing portion 302 may also be composed of plastic, wood, metal, concrete, elastomer, foam, an aqueous element such as gel or water inside a pouch, or any other element known to those of in the art. Additionally, impact-absorbing portion 302 may provide for one or more top-side coverings 398 that may be adapted to for use with plurality of fanciful elements 105, such as but not limited to a fabric or other additional layer that prevents plurality of fanciful elements 105 from passing into impact-absorbing portion 302 or bottom 301.

Figure 5:
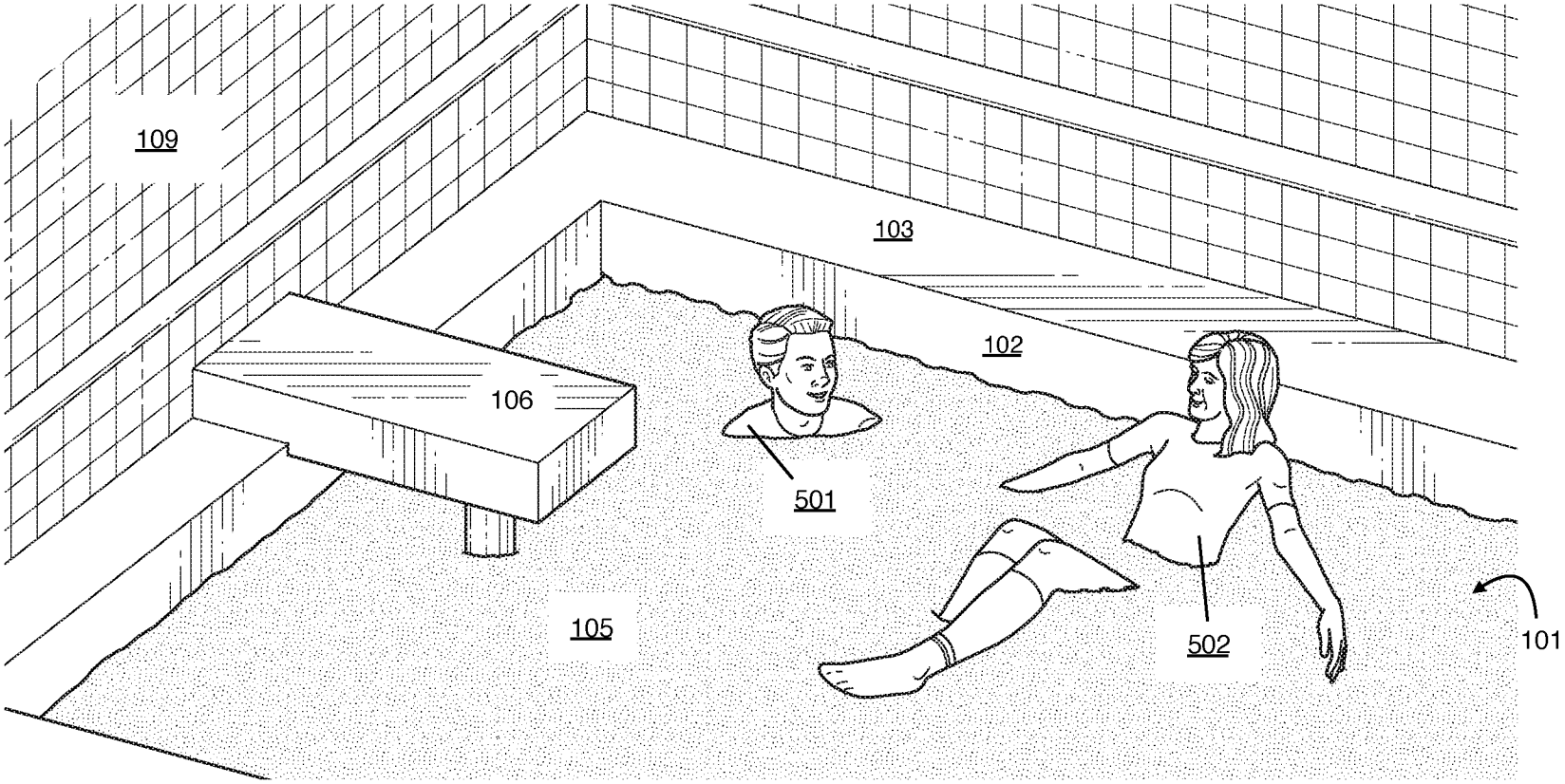
FIG. 5 illustrates an exemplary method for simulating immersion in a confection in accordance with an embodiment of the invention.

Remaining with FIG. 3, in some embodiments pole 303 may be cylindrical, as generally disclosed in FIG. 1, FIG. 3, and FIG. 5. In other embodiments, pole 303 may be shaped as a plank, or a fanciful shape such as a surfboard, a pyramid, an ice cream cone, or any other shape. Those of skill in the art will recognize that in embodiments wherein diving board 106 is not configured to bear substantial weight, pole 303 may be purely decorative, configured to support a modicum of weight, or configured to support more than a modicum of weight. In some embodiments, the present invention may provide for a plurality of poles 303, such as by way of non-limiting example, a series of poles 303 to support one or more diving boards 106.

With continuing respect to FIG. 3, platform support area 304 may be entirely or substantially planar, or may provide for one or more protrusions or deviations, such as lumps or crevices. Platform support area 304 may also be composed of plastic, wood, metal, concrete, elastomer, foam, an aqueous element such as gel or water inside a pouch, or any other element known to those of in the art. Additionally, platform support area 304 may provide for one or more front- or inner-side coverings that may be adapted to for use with plurality of fanciful elements 105, such as but not limited to a fabric or other additional layer that prevents plurality of fanciful elements 105 from passing into platform support area 304. In some embodiments, platform support area 304 may be of one continuous portion with impact-absorbing surface 302, bottom 301, or both. In some embodiments, either platform support area 304 or bottom 301, or both, may provide for a surface upon which container 101 may rest or be affixed. The portions of platform support area 304 not shown in the cross-section view of FIG. 3 may include support beams, a leveled earth foundation, a surface that can raise or lower via hydraulics, or any other surface upon which container 101 and/or other elements of the present invention may rest or be attached.

Figure 4A:
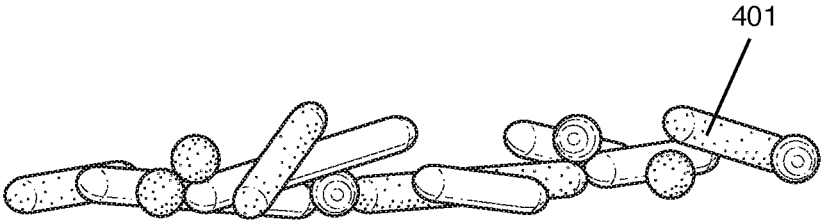
FIG. 4A shows exemplary fanciful elements shaped as sprinkles configured for use within a system for simulating immersion in a confection in accordance with an embodiment of the invention.
Figure 4B:
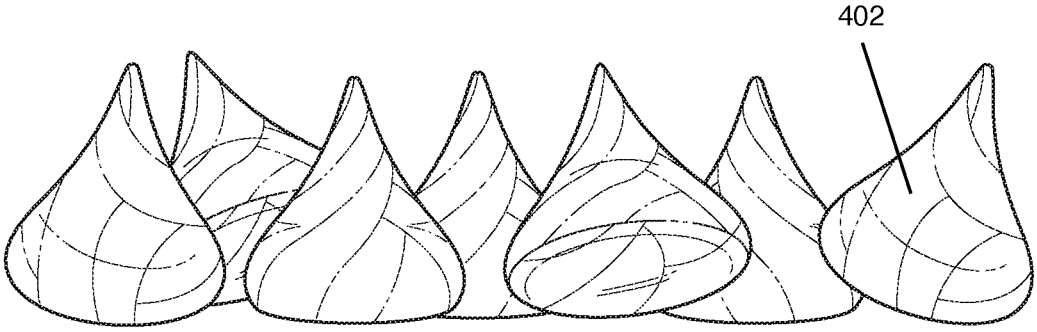
FIG. 4B shows exemplary fanciful elements shaped as chocolate chips configured for use within a system for simulating immersion in a confection in accordance with an embodiment of the invention.
Figure 4C:
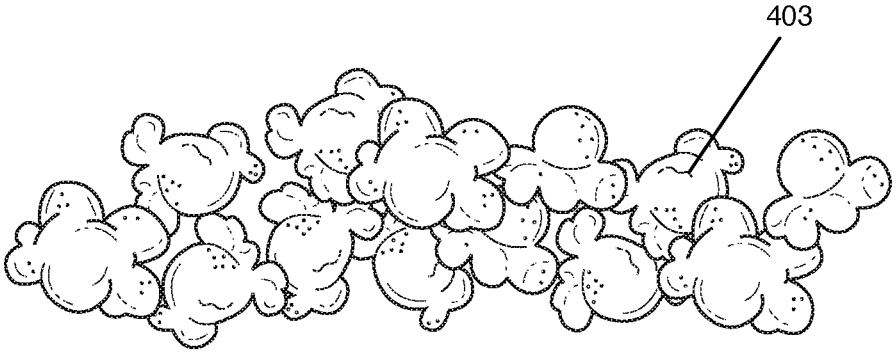
FIG. 4C shows exemplary fanciful elements shaped as popped pieces of popcorn configured for use within a system for simulating immersion in a confection in accordance with an embodiment of the invention.

Turning attention to FIG. 4A, FIG. 4B, and FIG. 4C, a viewer may perceive a series of exemplary fanciful elements configured for use within a system for simulating immersion in a confection in accordance with at least one embodiment of the invention.

First, FIG. 4A discloses non-limiting exemplary fanciful element 104 shaped as sprinkles 401. In some embodiments, sprinkles 401 may be shaped differently from the embodiment disclosed in FIG. 4A. For example, in some embodiments, sprinkles 401 may be longer, shorter, thicker, or thinner than disclosed in FIG. 4A.

Similarly, FIG. 4B discloses non-limiting fanciful element 104 shaped as chocolate chips 402. In some embodiments, chocolate chips 402 may be shaped differently from the embodiment disclosed in FIG. 4B. For example, in some embodiments, chocolate chips 402 may be taller, shorter, thicker, or thinner than disclosed in FIG. 4B.

Additionally, FIG. 4C discloses non-limiting fanciful element 104 shaped as popped pieces of popcorn 403. In some embodiments, popped pieces of popcorn 403 may be shaped differently from the embodiment disclosed in FIG. 4C. For example, in some embodiments, popped pieces of popcorn 403 may be longer, shorter, thicker, thinner, or may be shaped as mushroom flakes, butterfly flakes, or other shapes of popped pieces of popcorn 403 than disclosed in FIG. 4C.

Fanciful element 104, such as but not limited to sprinkles 401, chocolate chips 402, or popped pieces of popcorn 403, may in some embodiments, be comprised of a composition. In such embodiments, it is contemplated that the composition of fanciful element 104 may comprise about 90-97% plastic, about 2-9% coloring agent, and about 1-8% antimicrobial agent by weight. In some embodiments, the plastic composition of some or all of the fanciful elements may comprise about 95-97.5% plastic, about 2-4.5% coloring agent, and about 0.5-1% antimicrobial agent by weight (at times abbreviated "wt. %" herein). In some embodiments, the plastic may provide consistency and resiliency.

In some embodiments, the coloring agent may impart an aesthetic. Additionally, the present invention may provide, purely by way of illustration and not limitation, that one or more coloring agents may be provided sufficient to dye at least one fanciful element 104 green, red, yellow, pink, blue, orange, white, or any shade of any color known in the art.

In some embodiments, the antimicrobial agent may prevent the growth or spread of bacteria on fanciful element 104 or plurality of fanciful elements 105, and may also prevent the spread of microbes from fanciful element 104 or plurality of fanciful elements 105 to the other elements of the present invention, such as but not limited to container 101, container walls 102, container upper surface 103, diving board 106, ladder 107, platform surface 108, platform walls 109, novelty item 110, stairs 111, or any other element or surface of the present invention.

By way of example, the following chart illustrates three non-limiting example compositions:

| Ingredient | Percentage |
|---|---|
| Example 1 | |
| Plastic | 97 |
| Coloring Agent | 2 |
| Antimicrobial Agent | 1 |
| | Total: 100% |
| Example 2 | |
| Plastic | 96 |
| Coloring Agent | 3 |
| Anbtimicrobial Agent | 1 |
| | Total: 100% |
| Example 3 | |
| Plastic | 95 |
| Coloring Agent | 4 |
| Antimicrobial Agent | 1 |
| | Total: 100% |

Fanciful element(s) 104 generally disclosed in FIG. 4, and elsewhere herein, are contemplated to be plastic, although not necessarily so, recreations of known objects. Thus, sprinkles 401, chocolate chips 402, and popped pieces of popcorn 403 may, in some embodiments, be larger or smaller than their real-life counterparts, and may be made from a polymer, wood, metal, elastomer, or any similar element named herein or any equivalent, or any combination of such elements. Furthermore, in some embodiments, plurality of fanciful elements 105 may comprise a combination of sprinkles 401, chocolate chips 402, and/or popped pieces of popcorn 403, along with any combination of any other embodiment of fanciful element 104 such as the shapes discussed above. For example, as mentioned above, fanciful element 104, in addition or in combination with the shapes of sprinkles 401, chocolate chips 402, and popped pieces of popcorn 403 may, in some embodiments, be shaped as a real (or "natural"), synthetic, or semi-synthetic sprinkle 401, popsicle, gummy bear, ice cream cone, scoop of ice cream, cone, chocolate chip 402, brownie, cookie, a candy or candy bar, a dessert topping, or another sweet treat or combination of sweet treats, a miniature reproduction of a savory treat, such as by way of illustration and not limitation, popcorn 403 (popped or unpopped), small slices of pizza, small slices of bacon, a cereal, a meatball, a meatball sandwich, a star, a human likeness, a creature, a doll, an accessory such as a cowboy hat or purse, an emoji, a thumbs-up, a shape such as a sphere or cube, a plurality of shapes of varying sizes, and so forth.

FIG. 5 illustrates an exemplary method for simulating immersion in a confection in accordance with an embodiment of the invention. In the embodiment depicted, a viewer may perceive first user 501 and second user 502, along with container 101, container walls 102, container upper surface 103, plurality of fanciful elements 105, diving board 106, and platform walls 109.

In the embodiment generally depicted in FIG. 5, the method may comprise the step(s) of providing a container 101 having at least one container upper surface 103 and at least one stationary diving board 106 and at least one ladder disposed on the container upper surface 103. Additionally, the method may comprise the step(s) of loosely distributing a plurality of fanciful elements 105 shaped as multicolored sprinkles 401 into container 101, wherein the plurality of fanciful elements 105 are removably positioned within the container. Furthermore, the method may comprise the step (s) of first user 501 and/or a second user 502 placing at least one body part into the plurality of fanciful elements 105.

Figure 6:
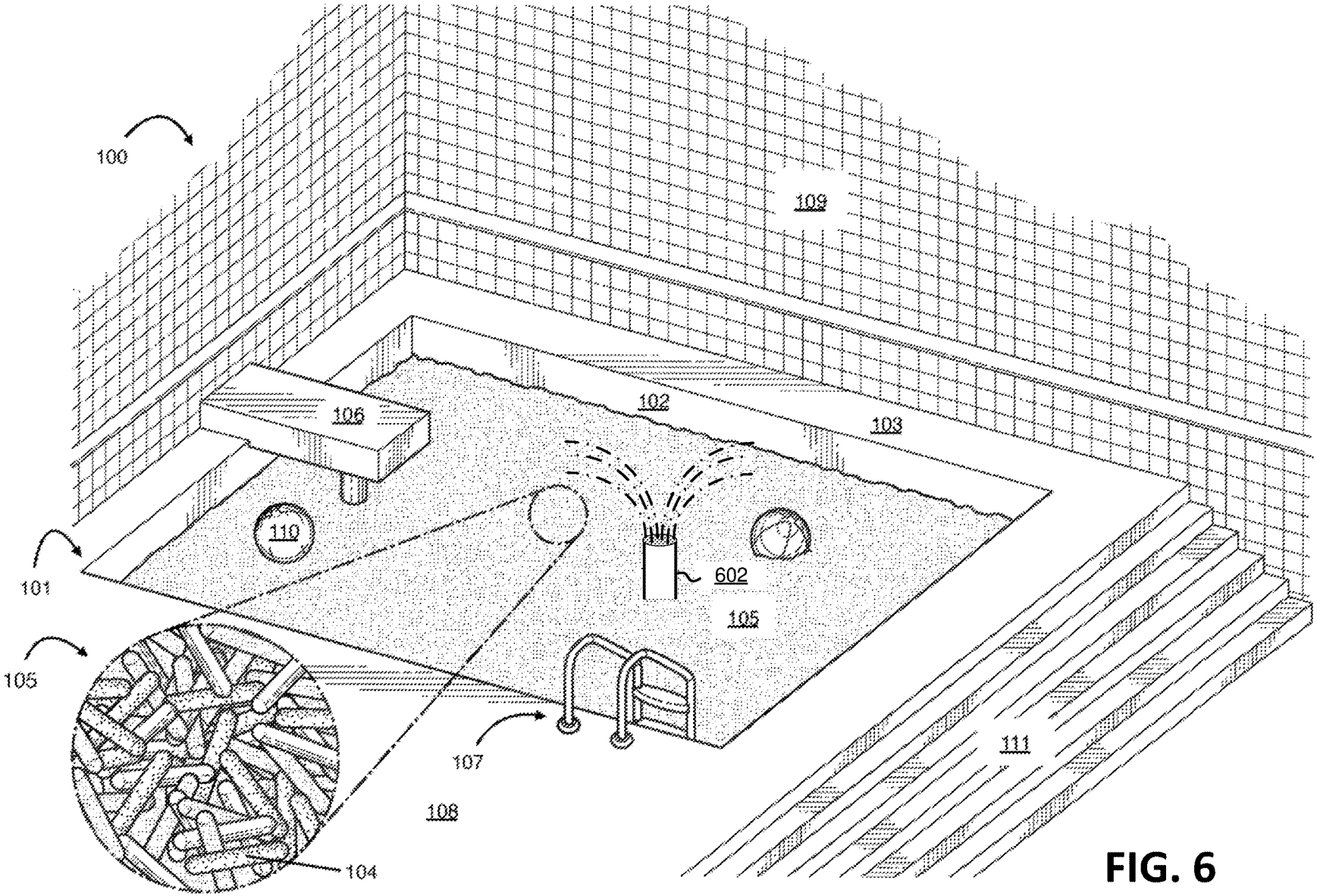
FIG. 6 shows a top-perspective view of a system for simulating immersion in a confection in accordance similar to that depicted in FIG. 1 with a fountain 602 cycling fanciful elements like a traditional fountain cycles water in an embodiment of the invention.

FIG. 6 shows a top-perspective view of a system for simulating immersion in a confection in accordance similar to that depicted in FIG. 1 with a fountain 602 cycling fanciful elements like a traditional fountain cycles water in an embodiment of the invention.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Conclusions, Ramifications, and Scope

While certain embodiments of the invention have been illustrated and described, various modifications are contemplated and can be made without departing from the spirit and scope of the invention. Accordingly, it is intended that the invention not be limited, except as by the appended claim(s).

The teachings disclosed herein may be applied to other systems, and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions and concepts of the various references described above to provide yet further embodiments of the invention.

Particular terminology used when describing certain features or aspects of the invention should not be taken to imply that the terminology is being refined herein to be restricted to any specific characteristics, features, or aspects of the present invention with which that terminology is associated. In general, the terms used in the following claims should not be constructed to limit the present invention to the specific embodiments disclosed in the specification unless the above description section explicitly define such terms. Accordingly, the actual scope encompasses not only the disclosed embodiments, but also all equivalent ways of practicing or implementing the disclosed present invention. The above description of embodiments of the present invention is not intended to be exhaustive or limited to the precise form disclosed above or to a particular field of usage.

While specific embodiments of, and examples for, the present invention are described above for illustrative purposes, various equivalent modifications are possible for which those skilled in the relevant art will recognize.

While certain aspects of the present invention are presented below in particular claim forms, various aspects of the present invention are contemplated in any number of claim forms. Thus, the inventor reserves the right to add additional claims after filing the application to pursue such additional claim forms for other aspects of the present invention.

What is claimed is:

1. An apparatus, comprising:

a container defining a cavity, the cavity being defined by at least one side and a bottom surface, the container comprising:

a wall portion defining the at least one side of the cavity; and at least one bottom portion defining the bottom surface of the cavity;

a plurality of fanciful elements loosely disposed within the cavity, each of the plurality of fanciful elements being granular, each of the plurality of fanciful elements having a coating mechanically applied thereon, the coating configured to reduce friction therebetween, thereby enabling the plurality of fanciful elements to substantially fluidly displace when a user inserts a body part therein;

an impact-absorbing portion above the bottom surface of the cavity and defining an impact-absorbing surface; and a covering disposed over the impact-absorbing surface and configured to prevent the plurality of fanciful elements from passing therethrough to prevent the plurality of fanciful elements from interfering with the impact-absorbing portion.

2. The apparatus of claim 1, wherein the fanciful elements are configured as multicolor plastic sprinkles.

3. The apparatus of claim 2, wherein the fanciful elements comprise an antimicrobial agent.

4. The apparatus of claim 3, wherein the fanciful elements comprise 90-97 wt. % plastic, 2-9 wt. % coloring agent, and 1-8 wt. % antimicrobial agent.

5. The apparatus of claim 1, wherein the container is shaped in the likeness of a hot tub.

6. The apparatus of claim 1, wherein the container is shaped in the likeness of an in-ground swimming pool.

7. The apparatus of claim 1, wherein the container is shaped in the likeness of an above-ground swimming pool.

8. The apparatus of claim 1, further comprising a ladder disposed on a particular side of the wall portion.

9. The apparatus of claim 1, further comprising a diving board extending over the cavity.

10. The apparatus of claim 9, wherein the diving board fully extends across the cavity.

11. The apparatus of claim 1, further comprising a fountain configured to cycle the plurality of fanciful elements.

12. The apparatus of claim 1, further comprising at least one novelty item removably positioned within the cavity.

13. The apparatus of claim 1, wherein the impact-absorbing portion includes a fluid contained in a pouch.

14. The apparatus of claim 1, wherein the impact-absorbing portion includes a series of one or more springs.

* * * * *